US006543490B1

(12) United States Patent
Owens

(10) Patent No.: US 6,543,490 B1
(45) Date of Patent: Apr. 8, 2003

(54) AEROSOL COLORANT CHARGING SYSTEM AND METHOD

(75) Inventor: Edward F. Owens, Lisle, IL (US)

(73) Assignee: United States Can Company, Lombardi, IL (US)

( * ) Notice: Subject to any disclaimer, the term of this patent is extended or adjusted under 35 U.S.C. 154(b) by 32 days.

(21) Appl. No.: 09/718,756

(22) Filed: Nov. 22, 2000

(51) Int. Cl.[7] ..... B67C 3/06

(52) U.S. Cl. ..... 141/20; 366/142; 366/151.2; 366/155.1; 366/160.3; 366/605

(58) Field of Search ..... 141/3, 20; 366/142, 366/151.1, 151.2, 155.1, 605, 160.1–160.4

(56) References Cited

U.S. PATENT DOCUMENTS

| | | | | |
|---|---|---|---|---|
| 3,797,534 | A | | 3/1974 | Skidmore |
| 4,403,866 | A | * | 9/1983 | Falcoff et al. |
| 4,705,083 | A | * | 11/1987 | Rossetti |
| 4,938,260 | A | | 7/1990 | Hirz |
| 4,967,938 | A | | 11/1990 | Hellenberg |
| 5,078,302 | A | | 1/1992 | Hellenberg |
| 5,328,057 | A | | 7/1994 | Hellenberg et al. |
| 5,377,724 | A | | 1/1995 | Ray |
| 5,480,288 | A | | 1/1996 | Hellenberg et al. |
| 5,647,408 | A | | 7/1997 | Erst et al. |
| 5,697,527 | A | | 12/1997 | Altieri, Jr. et al. |
| 5,711,458 | A | | 1/1998 | Langeveld et al. |
| 5,832,965 | A | | 11/1998 | Fasse et al. |

* cited by examiner

*Primary Examiner*—Charles E. Cooley
*Assistant Examiner*—David Sorkin
(74) *Attorney, Agent, or Firm*—Polster, Lieder, Woodruff & Lucchesi, LC

(57) ABSTRACT

A method and apparatus (10) for custom blending spray paints. A customer provides a sample (S) of a color to be matched. The sample is tested on a spectrophotometer to determine the colors needed to match the sample; or if the paint formula is known, it is entered into the apparatus. A computer control (16) causes metered quantities of each colorant to be pumped from a reservoir (50) to a manifold (68). From the manifold, paint is injected through a filling head (46) into a discharge valve (V) and dip tube (P) of a precharged aerosol container (C) to be filled. Solvent from a tank (74) is used between a final injection of colorant to flush out the manifold and a dip tube (P) of the container. After the colors have been injected into the container, the container is shaken so that the colors intermix with each other to produce a paint of the desired custom color which is readily sprayed from the container.

20 Claims, 3 Drawing Sheets

AEROSOL COLORANT CHARGING SYSTEM AND METHOD

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to pre-charged aerosol containers for dispensing paints, and more particularly, to a method and apparatus by which containers purchased by retail customers can be charged with custom blended colors at the point of sale so individual cans of aerosol paint contain colors which match a customers specific color needs.

Aerosol paint cans are well-known in the art. The can, which is pre-charged, is filled with a particular color (black, red, magenta, etc.). When a paint is applied, the user first shakes the container to insure the paint and propellant are uniformly mixed, points the spray nozzle at the object to be painted, then presses on a lever or the like to open a valve and release the paint through the nozzle. Heretofore, aerosol paint cans have only been filled with a single color; although, the color may be a blend of several colors. That is, the color is first mixed or blended and aerosol cans are then filled with the resulting color mix at the manufacturers. The containers are then shipped to retail outlets for purchase by end users. Previously, someone wanting to match a paint in an aerosol container with another color was limited to those colors the paint manufacturers made available. If someone needed a better color match than was available in these containers, they would have to match the color some other way. That is, they would have to buy a base color of paint in a conventional paint can, have the color blended with other colors to obtain the desired color match, and then apply the color using a brush or the like. Alternately, a commercial painter can have a conventional paint put into multiple aerosol cans.

In accordance with the present invention, it is now possible to custom mix colors in an aerosol container at a paint store or retail outlet so that a person wanting to apply paint from an aerosol container can purchase an aerosol container and then have the paint in the container custom matched to whatever color the customer needs.

BRIEF SUMMARY OF THE INVENTION

Among the several objects of the present invention may be noted the provision of apparatus and a method for custom mixing paint to match a sample provided by a customer, with the resulting custom blended paint being in an aerosol container;

- the provision of such apparatus and a method by which the custom color is blended by mixing two or more colors available at a retail outlet to produce the blended paint desired by the customer;
- the provision of such apparatus and a method in which the aerosol container is already filled with a propellant, solvent, and base paint so only the colorant required to produce the desired blended color needs to be added to the aerosol container at the point of purchase;
- the provision of such apparatus and method to enter a formula for the desired color into the apparatus with the apparatus then delivering the colors included in the formula, in appropriate quantities, to the aerosol container;
- the further provision of such apparatus and a method in which a sample of a desired paint color provided by the customer is tested on a spectrophotometer or the like located at a point of sale so the various colors and their amounts required to be blended to obtain the custom color are identified;
- the provision of such apparatus and method in which the volume of each aerosol container is ascertained prior to delivering paints or colorants to the container so the precise quantities of paint or colorant to be delivered is determined;
- the additional provision of such apparatus and a method by which separate, metered amounts of those colors are injected into the aerosol container and intermixed with each other to produce the desired paint color;
- the provision of such apparatus and a method by which up to sixteen different colors are available for blending in the aerosol container;
- the provision of such apparatus and method in which paint is delivered into the container through a manifold and a solvent is injected into the aerosol container through the manifold after the final colorant injection;
- the provision of such apparatus and a method which is usable with a variety of paints including flat base, glossy, and semi-gloss, as well as metallic, metal flake, and wrinkle finish paints; and,
- the provision of such apparatus and a method by which a custom blended paint accurately matching the paint color needed by a purchaser is quickly and easily blended, with the custom blended paint being contained in an aerosol container so to be readily applied to a surface to be painted.

In accordance with the invention, generally stated, a customer provides a sample of a color to be matched. The sample is tested on a spectrophotometer to determine the colors needed to match the sample; or, the formula for the paint is entered into the apparatus using a data entry keyboard. A computer controlled mixing unit is responsive to the formulation determined from the testing to selectively inject predetermined quantities of selected paints or colorants through a manifold into a discharge valve and dip tube of an aerosol container. The container has been previously filled with a propellant, solvent, and base paint, and a solvent is injected into the aerosol container after the final colorant injection. After the colors have been injected into the container, the container is shaken so that the colors intermix with each other, the propellant, solvent, and resins to produce a paint of the desired custom color which is readily sprayed from the container. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 2:
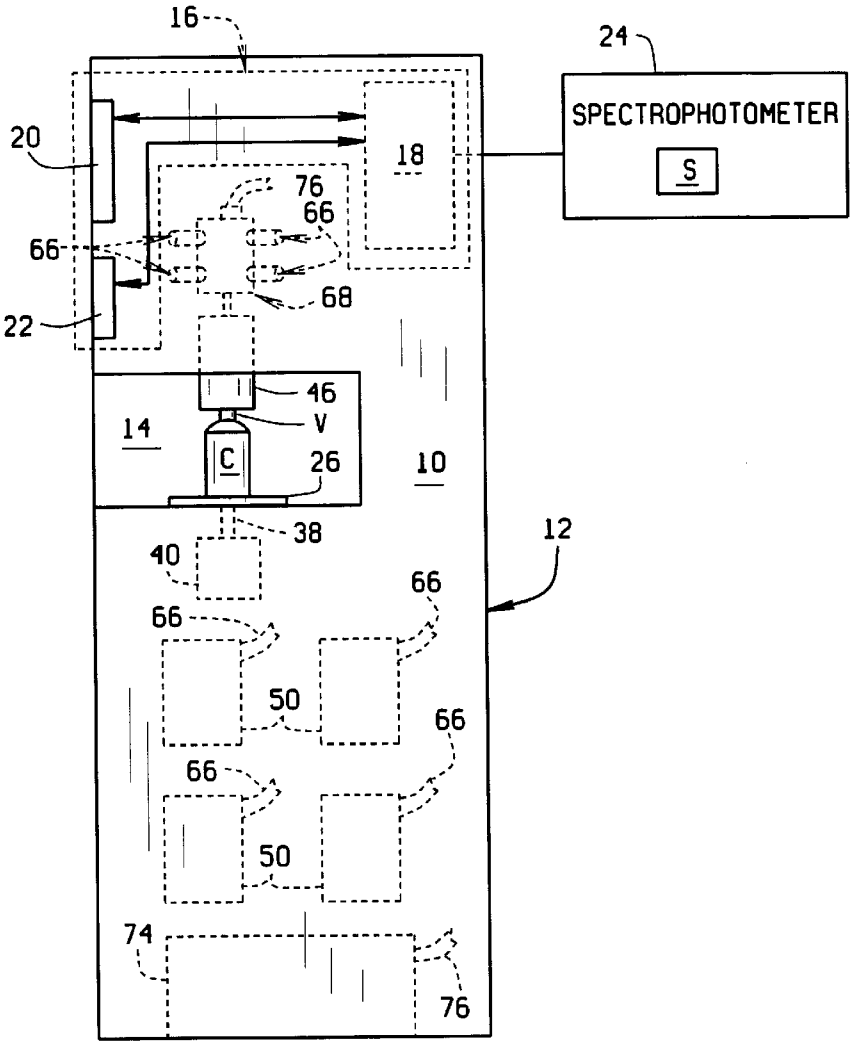
FIG. 2 is a simplified representation of a side elevational view of the apparatus.
Figure 1:
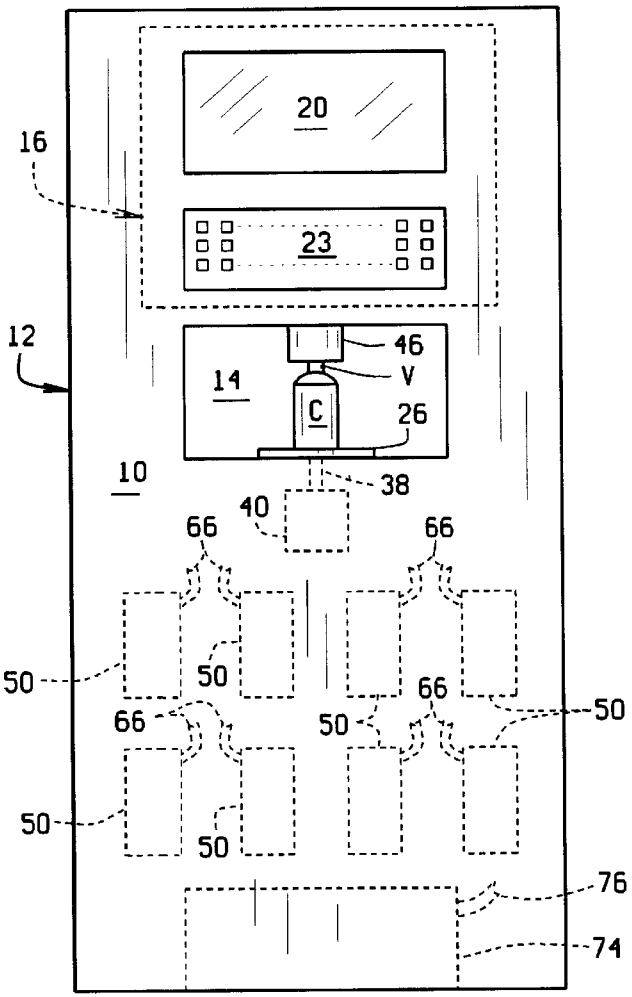
FIG. 1 is a simplified representation of a front elevational view of apparatus of the present invention for blending custom paint colors in an aerosol container.
Figure 3:
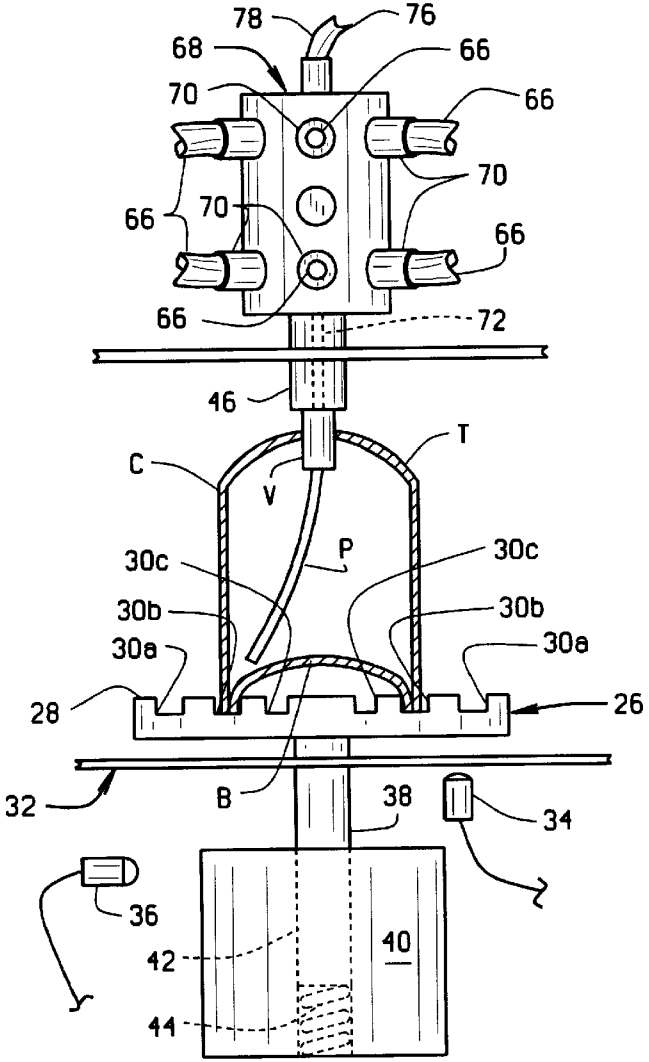
FIG. 3 illustrates an aerosol container filling mechanism of the apparatus.
Figure 6:
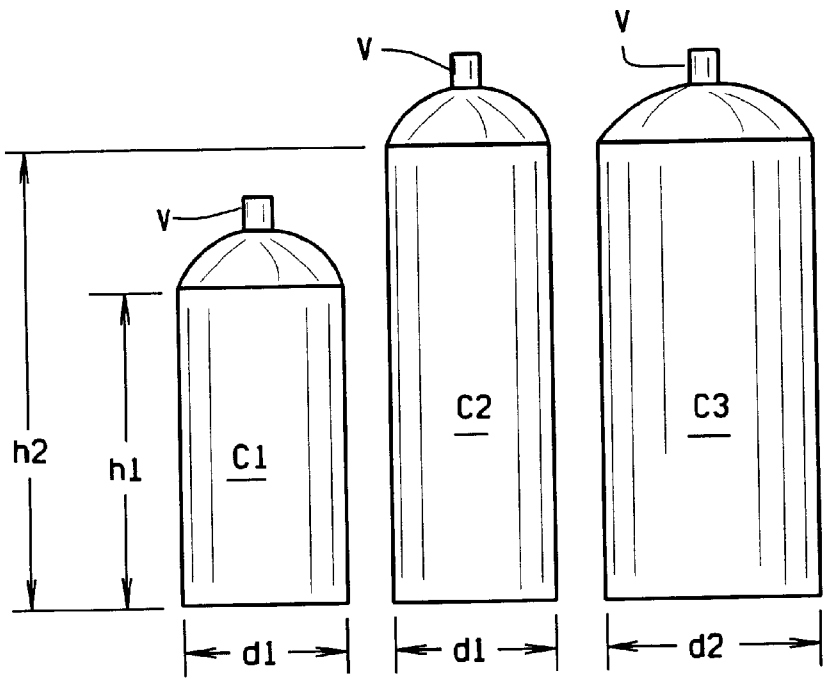

Referring to the drawings, apparatus of the present invention for filling an aerosol container C with a mixture of paints from which a custom color or desired color is produced is indicated generally 10 in FIGS. 1 and 2. Aerosol containers are available in different sizes. Representative containers C1–C3 are shown in FIG. 6 in which container C1 has a height $h_1$ which is shorter than the height $h_2$ of containers C2 and C3, and container C3 has a diameter $d_2$ which is greater than the diameter $d_1$ of containers C1 and C2. As is well understood by those skilled in the art, such dimensional differences results in each container holding different volumes of fluid (i.e., paint). Referring to FIG. 3, an aerosol container C is shown in section. The container is of a cylindrical shape and has a dome shaped bottom B and top T. A discharge valve V is fitted into the top T of the container. A dip tube P extends generally the height of the container with the upper end of the tube connecting with the discharge valve. In accordance with the invention, the aerosol containers are shipped from their manufacturers precharged with a propellant for spraying fluid out of the container, a solvent, base paint, and a resin. However, the paint in the container does not the final colorant in it when the container is shipped.

Apparatus 10 comprises a cabinet 12 in which is housed paint colorants used to tint paint to a desired color, a solvent, an aerosol container filling station 14 at which the containers are filled, and a control means indicated generally 16 by which the apparatus is controlled. The apparatus is conveniently located in the paint department of a store and is typically operated by the same personnel who custom mix paints stored in paint cans rather than aerosol containers. Control means 16 includes a computer 18, a monitor 20, and a keyboard 22. If a customer wishes to have a custom paint of known formulation made, the operator can type the formulation into computer 18 using keyboard 20, with monitor 20 displaying the information entered. If the desired paint color formulation is not known, a sample S of the paint is supplied to a spectrophotometer 24 (see FIG. 2) which analyzes the sample and provides an input to computer 18 of the paint constituents.

The operator next places an aerosol container C on a platform 26 installed in the base of filling station 14. The platform has a top surface 28 in which are formed a series of concentric rings or grooves 30*a*–30*c*, the diameter of these rings conforming to the diameters $d_1$, $d_2$, etc. of the various size aerosol containers which can be filled using the apparatus. A means 32 for determining the volume of an aerosol container C includes the platform 26 upon which the aerosol container is placed further includes a first sensor 34 for measuring the diameter of the aerosol container when it is placed on the platform, and a second sensor 36 for measuring the height of the container. Sensor 34 measure the container's diameter by sensing in, which groove 30 the container is placed. Platform 30 sits upon a shaft 38. The other end of the shaft is installed in a plunger housing 40. The housing has a central opening 42 in which the shaft is inserted into the housing. The base of the shaft rests upon a spring 44. When the container is installed in filling station 14, discharge valve V is coupled to a filling head 46 which is fixed in place. The height of platform 26 is adjusted according to the height of the container. Height indicia is marked on the side of shaft 38 and sensor 36 senses this indicia and uses it to provide a height signal to the computer. Control means 16 is responsive to the diameter and height measurements from sensors 34 and 36 to calculate the volume of the container. This is important since the amount of paint colorant to be injected into the container to produce the desired color varies as function of the container's volume.

Figure 4A:
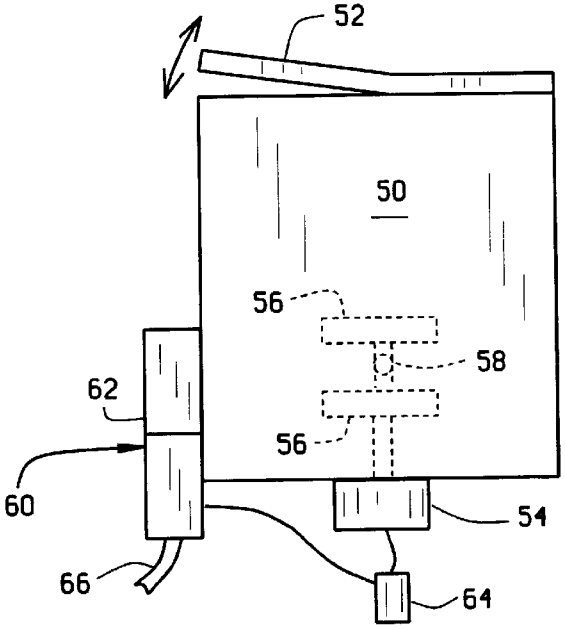
FIGS. 4A and 4B are respective side elevational and top plan views of a paint reservoir used in the apparatus.
Figure 4B:
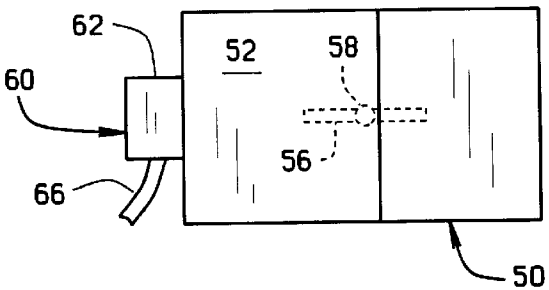

Cabinet 12 has space for a number of reservoirs 50 each of which is used to store a different color paint. Preferably, cabinet 12 holds up to sixteen different color paints; although not all of the paint reservoirs need be used at any one time. Further, more than one paint reservoir can hold the same color paint. Where a particular color, white or black, for example, is used much more often than another color, two or more of the reservoirs may be filled with these color paints. As shown in FIGS. 4A and 4B, each reservoir 50 has a hinged lid 52 for filling the reservoir with a paint. A motor driven agitator 54 includes paddles 56 mounted on a shaft 58 which extends into the interior of the reservoir. A motor driven metering pump 60 is responsive to input signals from control means 16 to pump a predetermined quantity of colorant from the reservoir for injection into the aerosol container. A motor 62 of pump 60 and the motor of agitator 54 are commonly'supplied power through an electrical connector 64. Paint pumped from each reservoir is discharged from the reservoir through a tube or hose 66.

Paint from each reservoir 50 is directed to a multi-ported manifold 68. The manifold has at least a number of ports corresponding to the number of paint reservoirs in use in the apparatus. The hose 66 from each reservoir is connected to the manifold through a one-way inlet valve 70. These valves are controlled by control means 16 so that paint from only one reservoir is admitted into manifold 68 at any one time. From the manifold, the paint flows through a channel 72 in filling head 46 to discharge valve V of the aerosol container.

It will be appreciated that since a variety of different colorants flow through manifold 68 to aerosol containers, that unless the manifold is flushed out after each aerosol can is treated, contamination of the manifold will result and the colors produced from the injection of various paints into an aerosol container will not be the color desired by the purchaser. It is also important to clear the dip tube in the aerosol container of colorant after all of the colorant has been added to the base paint in the container.

Figure 5:
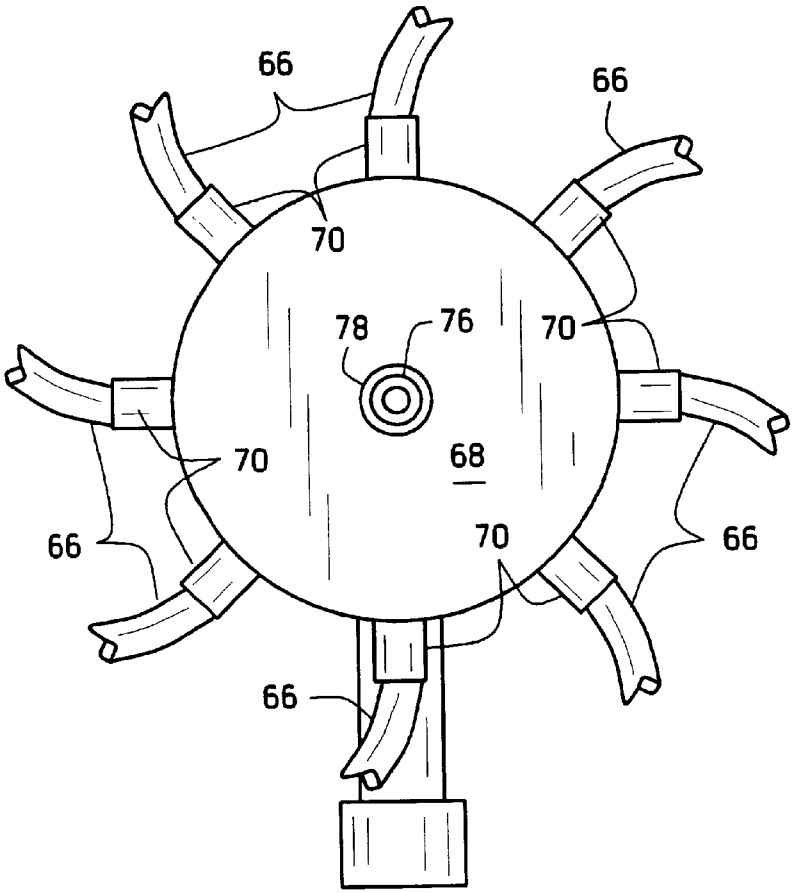
FIG. 5 is a top plan view of a manifold for delivering quantities of paint from paint reservoirs to the aerosol containers; and, FIG. 6 illustrates different size aerosol containers which are filled using the apparatus.

To prevent manifold contamination and clear the dip tube, the method of the invention includes flowing a paint solvent through the manifold and the dip tube, as the last step in tinting the paint inside the container so to flush colorant out of the manifold and tube. Apparatus 10 includes a solvent tank 74 located in the bottom of cabinet 12. The solvent tank has a metering pump (not shown) by which a measured amount of solvent is discharged from the tank to the manifold through a hose 76. As shown in FIGS. 3 and 5, hose 76 is attached to the top of the manifold through another one-way valve 78. When valve 78 is opened, solvent flows through the main fluid flow passage (not shown) in the manifold, through passage 72 in filling head. 46 and into the discharge valve.

In operation in accordance with the invention, the formula for a desired paint color is first established. If the formula is already known, it is entered into control means 16 via keyboard 22. If it is not, a paint sample S is analyzed by spectrophotometer 24 and the results provided to computer 18 of the control means. Next, an aerosol container C is installed in filling station 14 on platform 26. Sensors 34 and 36 measure the diameter and height of the container which enables computer 18 to determine the volume of the container. Once the volume is known, computer 18 determines the quantity of each colorant required by the formula or spectrophotometer analysis which needs to be injected into the container to produce the desired color. Control means 16 then sequentially operates the metering pump 60 of each colorant reservoir 50 to deliver the requisite amount to and through manifold 68 to filling head 46 and into the container. The control means is further operative to pump a measured amount of solvent from tank 74 to the manifold, after the final flow of colorant through the manifold, to flush any colorant remaining in the manifold's main flow passage and in the aerosol container's dip tube, into the aerosol container. After filling, the paint contents of the container will mix together when the container is shaken prior to use. Since the container is already filled with propellant, solvents, and resins prior to filling at station 14, the desired color paint can be sprayed onto whatever object the user is painting.

What has been described is custom mixing paint in an aerosol container to produce a desired color. The custom color is a mixture of two or more colors each of which is separately injected into the container. The volume of each aerosol container is ascertained prior to delivering paints to the container so precise quantities of colorant to be delivered is determined. Finally, the apparatus and a method of the invention is usable with a variety of paints such as flat base, glossy, and semi-gloss paints, as well as metallic, metal flake, and wrinkle finish paints.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. Apparatus for custom blending a paint of a desired color which is stored, under pressure, in an aerosol container comprising:

colorant supply means for supplying colorants of different colors to fill the aerosol container and including means metering the amount of each color supplied to the container, the different colorants, together with other paint components already in the aerosol container, producing the desired paint color when mixed together;

control means for controlling operation of the colorant supply means to meter an appropriate quantity of each selected colorant required to produce the desired color; and, injection means for injecting the metered quantities of each colorant from the colorant supply means into the pressurized aerosol container through a fluid discharge valve of the container, the colors injected into the container, when mixed together in the pressurized aerosol container, producing the desired color, with the aerosol container enabling a user to spray paint of the desired color onto an object.

2. The apparatus of claim 1 wherein the colorant supply means includes a plurality of colorant reservoirs, one for each color used to blend paints.

3. The apparatus of claim 2 wherein the colorant supply means further includes a metering pump for each reservoir for pumping a predetermined quantity of colorant from the reservoir.

4. The apparatus of claim 3 wherein the discharge valve of the aerosol container includes a dip tube in fluid communication with the discharge valve and extending into the container for the fluid material to be directed to the discharge valve through the dip tube, the apparatus further including an aerosol filling head by which metered amounts of any colorant injected into the aerosol container through the discharge valve and dip tube is injected through a single channel formed in the filling head, each colorant being delivered to the dip tube through said single channel.

5. The apparatus of claim 4 wherein the colorant supply means further includes a manifold interposed between the reservoirs and the aerosol filling head and in fluid communication therewith whereby colorant required to produce the desired color is pumped from the respective reservoirs to the manifold and from the manifold to the filling head.

6. The apparatus of claim 5 wherein the colorant supply means further includes a reservoir containing a solvent and means for supplying the solvent to the aerosol container.

7. The apparatus of claim 6 wherein the means for supplying the solvent includes a metering pump for delivering a predetermined amount of solvent from the solvent reservoir to the manifold for injection into the aerosol container, the control means controlling operation of the colorant supply means such that solvent is injected into the aerosol container after a final injection of a colorant into the aerosol container, thereby to prevent color contamination by removing all of the colorant from the manifold and dip tube.

8. The apparatus of claim 7 further including an agitator installed in each reservoir for agitating the contents of the reservoir to keep them thoroughly mixed.

9. The apparatus of claim 1 wherein the control means includes means for determining the volume of the aerosol container so the quantities of colorant to be delivered to the aerosol container are determined as a function of the container volume.

10. The apparatus of claim 9 wherein the means for determining the volume of an aerosol container includes a movable platform upon which the aerosol container is placed prior to filling.

11. The apparatus of claim 10 further including a first sensor for measuring the diameter of an aerosol container placed on the platform, and a second sensor for measuring the height of the container, the control means being responsive to the diameter and height measurements to calculate the volume of the container.

12. The apparatus of claim 1 wherein the control means includes data entry means by which colors to be injected into the aerosol container can be entered into the control means for the control means to then have those colors, in the appropriate quantities, delivered to the aerosol container.

13. The apparatus of claim 10 further including color analyzing means analyzing a sample of the desired color to determine which colors and the quantities thereof are needed to produce the desired color, the results of an analysis being supplied by the color analyzing means to the control means.

14. Paint mixing apparatus for custom blending a paint of a desired color which is stored in a precharged, pressurized aerosol container comprising:

colorant supply means for supplying colorants of different colors to tint a base paint within the aerosol container and including means for metering the amount of each colorant supplied to the container, the different colorants and base paints producing the desired paint color when mixed together;

measuring means for measuring the size of an aerosol container to be filled with the different colorants so the volume of the aerosol container can be determined;

control means for controlling operation of the colorant supply means to meter an appropriate quantity of each selected colorant required to produce the desired color, the control means being responsive to the measuring means to determine the volume of the aerosol container and the quantity of each selected colorant to be delivered to the container; and, means for injecting the metered quantities of each colorant from the colorant supply means into the aerosol container through a discharge valve of the container, the colorants injected into the container, when mixed together, producing the desired color, with the aerosol container enabling a user to spray paint of the desired color onto an object.

15. The apparatus of claim 14 wherein the control means includes data entry means by which colors to be injected into the aerosol container can be entered into the control means for the control means to then have those colors, in appropriate quantities, delivered to the aerosol container.

16. The apparatus of claim 15 further including color analyzing means analyzing a sample of the desired color to determine which colors and the quantities thereof are needed to produce the desired color, the results of an analysis being supplied by the color analyzing means to the control means.

17. The apparatus of claim 14 wherein the colorant supply means includes a plurality of reservoirs, one for each colorant used to blend paints, and a metering pump for each reservoir for pumping a predetermined quantity of colorant from the reservoir.

18. The apparatus of claim 17 wherein the discharge valve of the aerosol container includes a dip tube in fluid communication with the discharge valve and extending into the container for the fluid material to be directed to the discharge valve through the dip tube, the apparatus further including an aerosol filling head by which a metered amount of any colorant injected into the aerosol container through the discharge valve and dip tube is injected through a single channel formed in the filling head, each colorant being delivered to the dip tube through said single channel.

19. The apparatus of claim 18 wherein the colorant supply means further includes a manifold interposed between the reservoirs and the aerosol filling head and in fluid communication therewith whereby colorant required to produce the desired color is pumped from the respective reservoirs to the manifold and from the manifold to the filling head.

20. The apparatus of claim 19 wherein the colorant supply means further includes a reservoir containing a solvent and a metering pump for delivering a predetermined amount of solvent from the solvent reservoir to the manifold for injection into the aerosol container, the control means controlling operation of the colorant supply means such that solvent is injected into the aerosol container after a final injection of colorant into the aerosol container, thereby to prevent color contamination of the manifold and the aerosol container's dip tube.

* * * * *